US011498649B2

(12) United States Patent
Xiong et al.

(10) Patent No.: US 11,498,649 B2
(45) Date of Patent: Nov. 15, 2022

(54) HAND-HELD UNDERWATER AIRCRAFT

(71) Applicant: BOYA GONGDAO (BEIJING) ROBOT TECHNOLOGY CO., LTD., Beijing (CN)

(72) Inventors: Minglei Xiong, Beijing (CN); Longdong Chen, Beijing (CN); Yijun Chen, Beijing (CN); Haijie Li, Beijing (CN); Kai Wang, Beijing (CN)

(73) Assignee: Boya Gongdao (Beijing) Robot Technology Co., Ltd., Beijing (CN)

( * ) Notice: Subject to any disclaimer, the term of this patent is extended or adjusted under 35 U.S.C. 154(b) by 0 days.

(21) Appl. No.: 17/287,666

(22) PCT Filed: Nov. 12, 2018

(86) PCT No.: PCT/CN2018/115068
§ 371 (c)(1),
(2) Date: Apr. 22, 2021

(87) PCT Pub. No.: WO2020/082441
PCT Pub. Date: Apr. 30, 2020

(65) Prior Publication Data

US 2021/0347454 A1 Nov. 11, 2021

(30) Foreign Application Priority Data

Oct. 22, 2018 (CN) ..... 201811229761.9
Oct. 22, 2018 (CN) ..... 201821709853.2

(51) Int. Cl.
*B63C 11/46* (2006.01)
*B63C 11/02* (2006.01)
(Continued)

(52) U.S. Cl.
CPC ..... *B63C 11/02* (2013.01); *B63C 11/46* (2013.01); *B63H 1/12* (2013.01); *B63H 5/08* (2013.01); *B63C 2011/028* (2013.01)

(58) Field of Classification Search
CPC ..... A63B 35/12; B63C 11/46; B63C 11/02; B63H 1/12; B63H 5/08
See application file for complete search history.

(56) References Cited

U.S. PATENT DOCUMENTS 3,584,594 A * 6/1971 Poutout ..... A63B 35/12 440/6
2012/0309241 A1* 12/2012 Yeo ..... B63C 11/46 440/49
2013/0291781 A1* 11/2013 Myers ..... B63C 11/46 114/315

FOREIGN PATENT DOCUMENTS

CN 203698636 U 7/2014
CN 208372405 U 1/2019

OTHER PUBLICATIONS

International Search Report, China National Intellectual Property Administration, dated Jun. 27, 2019.
(Continued)

*Primary Examiner* — Andrew Polay
(74) *Attorney, Agent, or Firm* — Bay State IP, LLC

(57) ABSTRACT

A handheld underwater aircraft includes a battery compartment (12) and propellers. There are at least two propellers, which are symmetrically distributed on both sides of the battery compartment (12), and are connected to the battery compartment (12). A special design with axes of the propellers being unparallel with an axis of the battery compartment (12) is adopted, and unparallel included angles make component forces generated by the various propellers in a direction of motion of a non-underwater aircraft offset each other, and enable the underwater aircraft to maintain bal-
(Continued)

anced and forward-forward motion. The design with the axes of the propellers being unparallel with the axis of the battery compartment (12) leads to a little power loss, but avoids a larger power loss caused by the impact of water on the human body, thereby comprehensively improving the thrust of the underwater aircraft in use.

8 Claims, 6 Drawing Sheets

(51) Int. Cl.
*B63H 1/12* (2006.01)
*B63H 5/08* (2006.01)

(56) References Cited

OTHER PUBLICATIONS

Written Opinion ISA, China National Intellectual Property Administration, dated Jun. 27, 2019.

* cited by examiner

HAND-HELD UNDERWATER AIRCRAFT

CROSS REFERENCE TO RELATED APPLICATION

This application is for entry into the U.S. National Phase under § 371 for International Application No. PCT/CN2018/115068 having an international filing date of Nov. 12, 2018, and from which priority is claimed under all applicable sections of Title 35 of the United States Code including, but not limited to, Sections 120, 363, and 365(c) and which in turn claims priority under 35 USC 119 to Chinese Patent Application No. 201811229761.9 filed on filed on Oct. 22, 2018 and Chinese Patent Application No. 201821709853.2 filed on Oct. 22, 2018.

TECHNICAL FIELD

The present disclosure relates to the field of underwater propulsion equipment, and in particular, to a handheld underwater aircraft.

BACKGROUND

Generally, in an underwater aircraft with a plurality of propellers, the axes of the propellers are parallel to each other, and are parallel to the direction of motion of the underwater aircraft, and the underwater aircraft has a relatively small size. When this type of product is used, water sprayed from a propeller screw of the propeller is easily splashed on the face or body of the user. This is more obvious for beginners in swimming or people with a wider body. As a result, on the one hand, a lot of thrust is lost; on the other hand, in order to prevent the water from impacting on the face and affecting the line of sight, it is necessary to adjust the posture of the arms or body, which limits the freedom of the body to a certain extent and reduces the overall experience.

SUMMARY

The technical problem to be solved by the present disclosure is to provide a handheld underwater aircraft to solve at least one of the above technical problems in view of the disadvantages of the prior art.

The technical solution of the present disclosure to solve the above technical problems is as follows: a handheld underwater aircraft, including a battery compartment and propellers; there are at least two propellers, which are symmetrically distributed on both sides of the battery compartment, and are connected to the battery compartment; and a special design in which axes of the propellers and an axis of the battery compartment form non-parallel included angles is adopted.

The present disclosure has the following beneficial effects: Propellers are arranged symmetrically with respect to a battery compartment, which can ensure the balance of the present disclosure and maintain straight-forward motion of the underwater aircraft; an axis of each of the propellers and an axis of the battery compartment is set to form a certain included angle, such that when the underwater aircraft is advancing in the water, there is an angular deviation between the water coming out of the propeller and the direction of motion of the underwater aircraft, and the water coming out of the propeller will not be sprayed on the face or body of a user against the direction of motion of the underwater aircraft; due to symmetrical arrangement of the propellers, component forces generated by the propellers in a direction of motion of a non-underwater aircraft offset each other out, so that the underwater aircraft maintains balanced and straight-forward motion; the arrangement that the axis of the propeller and the axis of the battery compartment form a certain included angle leads to a very small natural loss, but avoids a larger power loss caused by water impacting on the human body, and improves the efficiency of advancing of the underwater aircraft in the water; moreover, the water does not impact on the user's face, thereby effectively preventing the user from inhaling water, making the user feel more comfortable and safer, and effectively improving overall user experience.

On the basis of the above technical solution, the present disclosure may further be improved as follows.

Further, a water inlet end of the propeller is biased toward the battery compartment and the included angle is greater than 0 degree and less than 45 degrees.

The above further solution has the beneficial effects that the included angle between the propeller and the battery compartment should not be too large; when the included angle is too large, a greater natural loss is caused when the component forces generated in the direction of motion of the non-underwater aircraft offset each other, resulting in waste of energy.

Further, the included angle is preferably 0-10 degrees, and the optimal included angle is 5 degrees.

The above further solution has the beneficial effects that when the included angle between the axis of the propeller and the axis of the battery compartment is 0-10 degrees, relative to when the included angle is greater than 10 degrees and less than 45 degrees, the energy consumption of the propeller is significantly reduced under the same speed of motion of the present disclosure; when the included angle between the propeller and the battery compartment is 5 degrees, the natural loss is reasonably reduced, and more loss caused by the impact of the water on the human body is avoided, thereby improving forward thrust of the product in use on the whole.

Further, there are two propellers, and the two propellers are connected by a buoyancy block.

The above further solution has the beneficial effects that the two propellers are connected by the buoyancy block, which can reduce resistance and increase buoyancy without adding an external floating block, thereby preventing an external floating block device from falling into the water, sinking to the bottom and being lost, reducing device costs, and reducing operation steps.

Further, the buoyancy block is arranged in front of the battery compartment, and is a curved plate with a middle portion protruding forward.

The above further solution has the beneficial effects that the buoyancy block is arranged in front of the battery compartment, and is the curved plate with the middle portion protruding forward, so that the buoyancy block can function in the motion of the underwater aircraft in such a way that the protruding curved plate can reduce the resistance in advancing of the underwater aircraft.

Further, the propeller and the battery compartment are connected by a buoyancy bridge, and handles are arranged on the buoyancy bridge.

The above further solution has the beneficial effects that the propeller and the battery compartment are connected by the buoyancy bridge, and the buoyancy bridge also plays a role in increasing buoyancy; and the handles are arranged on the buoyancy bridge and facilitate the holding of the underwater aircraft by the user.

Further, the buoyancy bridge includes an upper buoyancy plate and a lower buoyancy plate which are arranged in parallel, and both ends of the upper buoyancy plate and both ends of the lower buoyancy plate are connected to the two propellers respectively; an upper end of the battery compartment is mounted on a middle portion of a lower surface of the upper buoyancy plate, and a lower end of the battery compartment is mounted on a middle portion of an upper surface of the lower buoyancy plate; the handles are symmetrically arranged on two sides of the battery compartment, an upper end of each of the handles is connected to the upper buoyancy plate, and a lower end of the handle is connected to the lower buoyancy plate; one of the handles is provided with a propeller switch, and the other handle is provided with a power switch.

The above further solution has the beneficial effects that the upper buoyancy plate and the lower buoyancy plate which are arranged in parallel not only improve the buoyancy of the underwater aircraft on the whole, but also are attractive in appearance; the battery compartment is mounted on middle portions of both the upper buoyancy plate and the lower buoyancy plate to ensure the balance of the underwater aircraft; the handles are symmetrically arranged on two sides of the battery compartment to ensure the balance of the underwater aircraft; the upper end of the handle is connected to the upper buoyancy plate, and the lower end of the handle is connected to the lower buoyancy plate; the vertically-arranged handle facilitates holding by the user, making it more convenient and comfortable to hold the underwater aircraft; one of the handles is provided with the propeller switch, the other handle is provided with the power switch, and the propeller switch and the power switch are arranged on the handle, facilitating operation by the user.

Further, the buoyancy block, the upper buoyancy plate, the lower buoyancy plate, and the handle each have a hollow structure.

The above further solution has the beneficial effects that the buoyancy block, the upper buoyancy plate, the lower buoyancy plate, and the handle each have the hollow structure, and the hollow structure increases the buoyancy, reduces the weight of the underwater aircraft, and reduces costs.

Further, the propellers are each a variable speed propeller, a gear adjustment switch for controlling the variable speed propeller is arranged on the handle or on a side wall of the battery compartment, and each of the variable speed propellers is correspondingly provided with one gear adjustment switch.

The above further solution has the beneficial effects that through the gear adjustment switch, the user can control the speed and direction of motion of the variable speed propeller by himself/herself.

Further, the handheld underwater aircraft further includes a status display screen, where the status display screen is arranged on an outer side wall of the battery compartment, and a power supply in the battery compartment and the propeller are in circuit connection with the status display screen; the status display screen is configured to display parameter information of the power supply in the battery compartment and the propeller;

the handheld underwater aircraft further includes a pressure sensor mounted on the lower front of the battery compartment, where the pressure sensor is in circuit connection with the status display screen, and the status display screen is configured to display detected data of the pressure sensor; and the handheld underwater aircraft further includes an indicator lamp arranged on the status display screen.

The above further solution has the beneficial effects that the pressure sensor can effectively measure the speed of motion and underwater penetration, which can be displayed on the status display screen; when the depth reaches a certain value, the indicator lamp flashes to remind the user that he/she may reach a dangerous depth; and the status display screen can display information of the underwater aircraft in real time.

Figure 1:
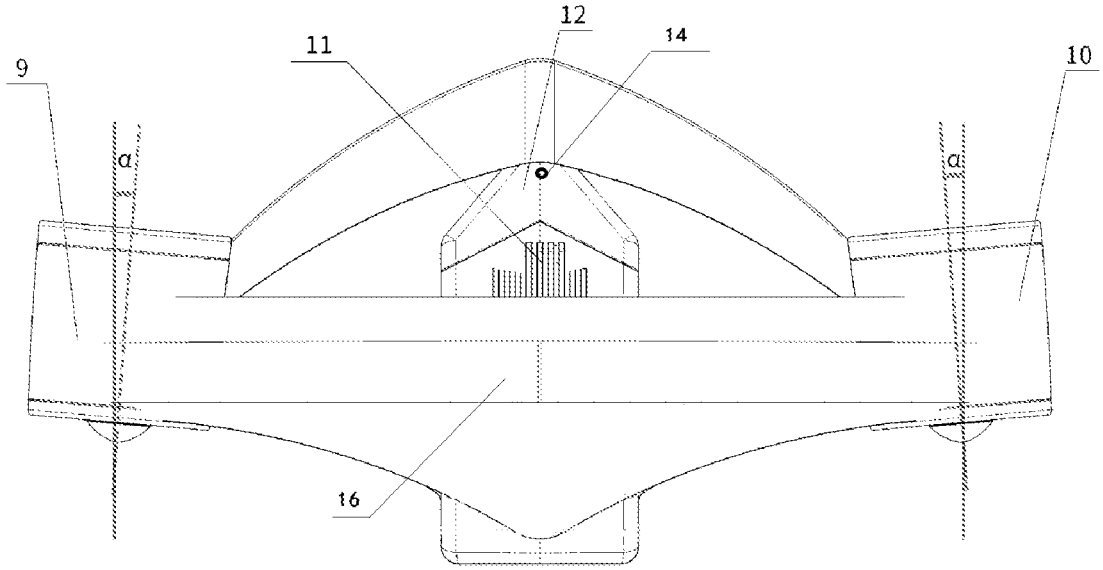
FIG. 1 is an upward view of the present disclosure.

In the drawings, the list of parts represented by numerical symbols is as follows:

1: propeller switch, 2: power switch, 3: status display screen, 4: right propeller body, 5: left propeller body, 6: buoyancy block, 7: right handle, 8: left handle, 9: right propulsion cylinder, 10: left propulsion cylinder, 11: external slot of a device, 12: battery compartment, 13: gear adjustment switch, 14: pressure sensor, 15: upper buoyancy plate, 16: lower buoyancy plate, 17: dynamic domain, 18: static domain, 19: simulated human body, 20: propeller outlet water.

DESCRIPTION OF THE EMBODIMENTS

The principles and features of the present disclosure are described below with reference to the accompanying drawings. The examples cited are only used to explain the present disclosure and are not used to limit the scope of the present disclosure.

Embodiment 1

Figure 2:
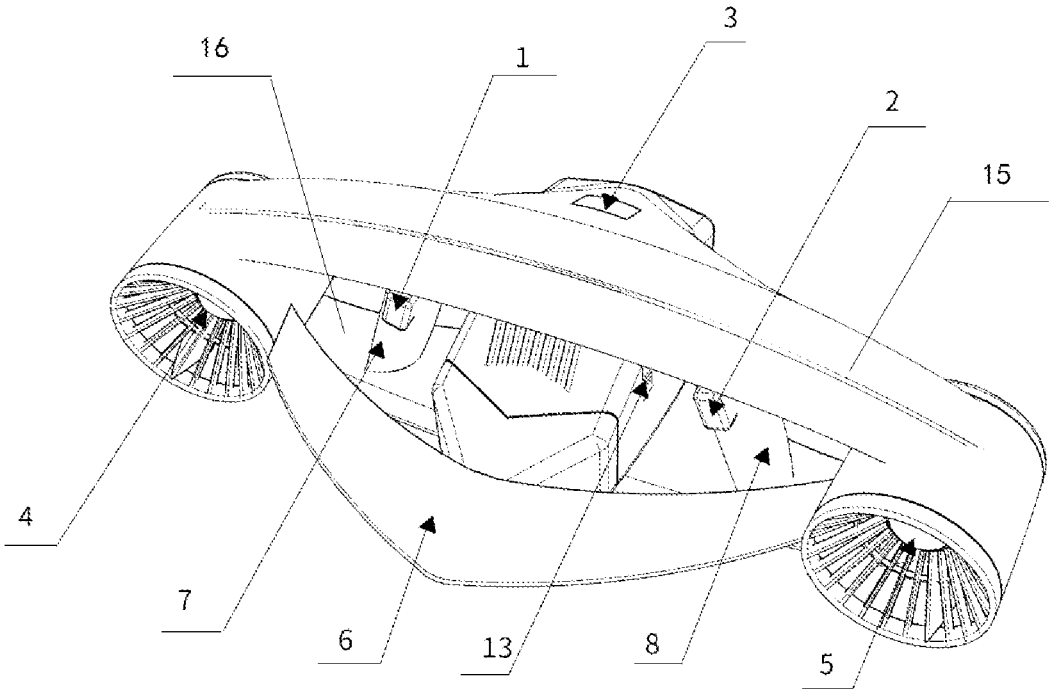
FIG. 2 is a perspective schematic diagram of the present disclosure.

As shown in FIGS. 1 and 2, a handheld underwater aircraft includes a battery compartment 12 and propellers, where there are at least two propellers, which are symmetrically arranged with respect to the battery compartment 12, and are connected to the battery compartment 12; and an axis of each of the propellers and an axis of the battery compartment 12 form an included angle.

This embodiment has the beneficial effects that the propellers are symmetrically arranged with respect to the battery compartment 12, which can ensure the balance of the underwater aircraft and maintain the straight forward motion of the underwater aircraft; axes of the propellers and an axis of the battery compartment 12 are set to form non-parallel included angles, such that when the underwater aircraft is advancing in the water, the water coming out of the propeller has a certain angular deviation from the direction of motion of the underwater aircraft, and the water coming out of the propeller will not be sprayed on the face or body of a user against the direction of motion of the underwater aircraft and will not obstruct the line of sight or lose power; due to symmetrical arrangement of the propellers, component forces generated by the propellers in a direction of motion of a non-underwater aircraft offset each other out, so that the underwater aircraft maintains balanced and straight-forward motion; the arrangement that the axis of each of the propellers and the axis of the battery compartment 12 form an included angle leads to a very small natural loss, but avoids a larger power loss caused by the water impacting on the human body, and improves the efficiency of advancing of the underwater aircraft in the water; moreover, the water does not impact on the user's face, thereby effectively preventing the user from inhaling water, making the user feel more comfortable and safer, and effectively improving overall user experience.

Embodiment 2

As shown in FIGS. 1 and 2, a handheld underwater aircraft includes a battery compartment 12 and propellers, where there are at least two propellers, which are symmetrically arranged with respect to the battery compartment 12, and are connected to the battery compartment 12; and an axis of each of the propellers and an axis of the battery compartment 12 form an included angle.

The battery compartment 12 has a power supply, and the power supply is connected to the propellers through a circuit to provide energy to the propellers.

Specifically, in this embodiment, there are two propellers: a left propeller and a right propeller, and water inlet ends of the propellers are biased toward the battery compartment 12. In some other specific implementations, there may be three propellers, the three propellers are symmetrically arranged with respect to the battery compartment 12 through connecting rods respectively, and water inlet ends of the propellers are biased toward the battery compartment 12. In some further specific embodiments, there are four propellers, two sides of the battery compartment 12 are each connected to two propellers, and water inlet ends of the propellers are biased toward the battery compartment 12.

The propellers each include a propeller body and a propulsion cylinder. A left propeller body 5 is mounted in a propulsion cylinder 10 and a right propeller body 4 is mounted in a right propulsion cylinder 9.

Specifically, the two propellers and the battery compartment 12 can be connected by connecting rods. In this embodiment, preferably, each of the propellers and the battery compartment 12 are connected by a buoyancy bridge, and the buoyancy bridge is provided with handles facilitating the holding by a user, the propeller and the battery compartment 12 are connected by the buoyancy bridge, and the buoyancy bridge also plays a role in increasing buoyancy; and the handles are arranged on the buoyancy bridge and facilitate the holding of the underwater aircraft by the user.

The propellers are symmetrically arranged with respect to the battery compartment 12, which can ensure the balance of the present disclosure and maintain the straight-forward motion of the underwater aircraft; the axis of each of the propellers and the axis of the battery compartment 12 are set to have an included angle, such that when the underwater aircraft is advancing in the water, there is a certain included angle between the water coming out of the propeller and the direction of motion of the underwater aircraft, and the water coming out of the propeller will not be sprayed on the face or body of the user against the direction of motion of the underwater aircraft; due to the symmetrical arrangement of the propellers, component forces generated by the propellers in the direction of motion of a non-underwater aircraft offset each other, so that the underwater aircraft maintained balanced and straight-forward motion; due to symmetrical arrangement of the propellers, component forces generated by the propellers in a direction of motion of a non-underwater aircraft offset each other out, so that the underwater aircraft maintains balanced and straight-forward motion; the arrangement that the axis of the propeller and the axis of the battery compartment 12 form a certain included angle leads to a very small natural loss, but avoids a larger power loss caused by water impacting on the human body, and improves the efficiency of advancing of the underwater aircraft in the water; moreover, the water does not impact on the user's face, thereby effectively preventing the user from inhaling water, making the user feel more comfortable and safer, and effectively improving overall user experience.

Specifically, the included angle between the axis of the propeller and the axis of the battery compartment 12 is a, where a is greater than 0 degree and less than 45 degrees, and an optimal included angle is 5 degrees. The included angle between the propeller and the battery compartment 12 should not be too large; when the included angle is too large, a greater natural loss is caused when the component forces generated in the direction of motion of the non-underwater aircraft offset each other, resulting in waste of energy.

The included angle $\alpha$ is preferably 0-10 degrees, and the optimal included angle $\alpha$ is 5 degrees. When the included angle between the axis of the propeller and the axis of the battery compartment is 0-10 degrees, relative to when the included angle is greater than 10 degrees and less than 45 degrees, the energy consumption of the propeller is significantly reduced under the same speed of motion of the present disclosure; when the included angle between the propeller and the battery compartment 12 is 5 degrees, the natural loss is reasonably reduced, and more loss caused by the impact of the water on the human body is avoided, thereby improving thrust in use on the whole.

Further, the two propellers are connected by the buoyancy block 6, which can reduce resistance and increase buoyancy without adding an external floating block, thereby preventing an external floating block device from falling into the water, sinking to the bottom and being lost, reducing device costs, and reducing operation steps. In the prior art, an external floating block generally needs to be additionally added to improve buoyancy.

Preferably, as shown in FIG. 1, the buoyancy block 6 is arranged in front of the battery compartment 12, and is a curved plate with a middle portion protruding forward; and the buoyancy block 6 is V-shaped as a whole, with a bent portion facing forward. The buoyancy block 6 is arranged in front of the battery compartment 12, and is the curved plate with the middle portion protruding forward, so that the buoyancy block 6 can function in the motion of the underwater aircraft in such a way that the protruding curved plate can reduce the resistance in advancing of the underwater aircraft.

As shown in FIGS. 1 and 2, the buoyancy bridge includes an upper buoyancy plate 15 and a lower buoyancy plate 16 which are arranged in parallel, and both ends of the upper buoyancy plate 15 and both ends of the lower buoyancy plate 16 are connected to the two propellers respectively; an upper end of the battery compartment 12 is mounted on a middle portion of a lower surface of the upper buoyancy plate 15, and a lower end of the battery compartment is mounted on a middle portion of an upper surface of the lower buoyancy plate 16; and handles are symmetrically arranged on two sides of the battery compartment 12. Specifically, in this embodiment, the handles include a left handle 8 and a right handle 7, where an upper end of the handle is connected to the upper buoyancy plate 15, and a lower end of the handle is connected to the lower buoyancy plate 16; one of the handles is provided with a propeller switch 1, and the other handle is provided with a power switch 2.

It can be understood that the upper buoyancy plate 15 and the lower buoyancy plate 16 which are arranged in parallel not only improve the buoyancy of the underwater aircraft on the whole, but also are attractive in appearance; the battery compartment 12 is mounted on middle portions of both the upper buoyancy plate 15 and the lower buoyancy plate 16 to ensure the balance of the underwater aircraft; the handles are symmetrically arranged on two sides of the battery compartment 12 to ensure the balance of the underwater aircraft; the upper end of the handle is connected to the upper buoyancy plate 15, and the lower end of the handle is connected to the lower buoyancy plate 16; the vertically-arranged handle facilitates holding by the user, making it more convenient and comfortable to hold the underwater aircraft; one of the handles is provided with the propeller switch 1, the other handle is provided with the power switch 2, and the propeller switch 1 and the power switch 2 are arranged on the handle, facilitating operation by the user.

Preferably, the buoyancy block 6, the upper buoyancy plate 15, the lower buoyancy plate, 16 and the handle each have a hollow structure. The hollow structure increases the buoyancy, reduces the weight of the underwater aircraft, and reduces costs. Moreover, the hollow structure facilitates the wiring arrangement of a circuit.

Preferably, the propellers are each a variable speed propeller, a gear adjustment switch 13 for controlling the variable speed propeller is arranged on the handle or on a side wall of the battery compartment 12, and each of the variable speed propellers is correspondingly provided with one gear adjustment switch 13.

Specifically, the propellers are each a variable speed screw propeller, and the variable speed adjustment of the propeller pertains to the prior art. Those skilled in the art can directly purchase the variable speed propeller, or realize the variable speed of the propeller according to common knowledge in the art.

It can be understood that through the gear adjustment switch 13, the user can control the speed and direction of motion of the variable speed propeller by himself/herself.

As shown in FIG. 1, the handheld underwater aircraft further includes a status display screen 3, where the status display screen 3 is arranged on an outer side wall of the battery compartment 12 to facilitate observation by the user, and a power supply in the battery compartment 12 and the propeller are in circuit connection with the status display screen 3; the status display screen 3 is configured to display parameter information of the power supply in the battery compartment 12 and the propeller.

As shown in FIG. 2, the handheld underwater aircraft further includes a pressure sensor 14 mounted on the lower front of the battery compartment 12, where the pressure sensor 14 is in circuit connection with the status display screen 3, and the status display screen 3 is configured to display detected data of the pressure sensor 14. In some embodiments, the underwater aircraft is not provided with a buoyancy block 6, and the pressure sensor 14 is directly mounted on the lower front of the battery compartment 12. In some other embodiments, the underwater aircraft is provided with a buoyancy block 6, the front end of the battery compartment 12 is connected to the buoyancy block 6, and the pressure sensor 14 is directly mounted on the lower front of the battery compartment 12 and outside the buoyancy block 6 to facilitate the detection by the pressure sensor 14.

The handheld underwater aircraft further includes an indicator lamp arranged on the status display screen 3. It can be understood that the pressure sensor 14 can effectively measure the speed of motion and underwater penetration, which can be displayed on the status display screen 3; when the depth reaches a certain value, the indicator lamp flashes to remind the user that he/she may reach a dangerous depth; and the status display screen 3 can display information of the underwater aircraft in real time.

A lower side wall of the battery compartment is provided with an external slot 11 of a device, which is configured to mount an external device to the battery compartment, so that the underwater aircraft can carry other devices.

Figure 3:
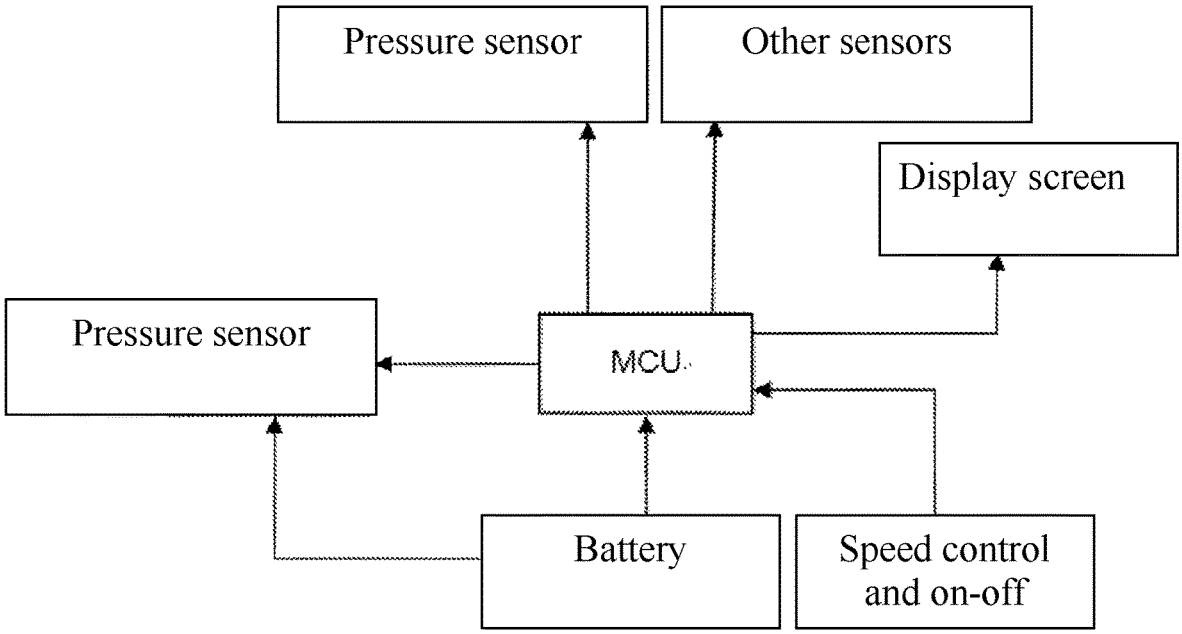
FIG. 3 is a schematic control diagram of the present disclosure.

As shown in FIG. 3, the pressure sensor 14 is connected to a micro control unit (hereinafter referred to as MCU) through a flat cable, and the flat cable takes into account the transmission of power and data. The MCU sends a read instruction to the sensor to read internal data of the sensor and implements related calculations to obtain required data.

Other sensors are carried on a control board in an underwater aircraft body, require no external circuit connection, and read and calculate data (such as electric quantity) in the MCU.

The status display screen 3 is connected to the MCU of the control board through a flat cable, and the flat cable takes the transmission of power and data into account. The MCU controls the content displayed on the display, including but not limited to obtained sensor values (such as brand LOGO).

The screw propeller is connected to the MCU through a propeller screw controller (the propeller screw controller is classified into a propeller screw category), a battery directly supplies electricity, and the propeller speed is directly controlled by a user input gear instruction obtained by the MCU (different gears can generate different speeds, resulting in different thrust).

Speed control and on-off are controlled by different positions of a magnetic body outside a sealed compartment (battery compartment 12). A magnetic sensing element in the sealed compartment (battery compartment 12) can sense different positions of external magnetic bodies, thereby generating corresponding signals to the MCU, so as to enable a user to input on-off and speed control instructions to the underwater aircraft.

On the whole, the user controls the state and speed (input between the human and the aircraft) of the power switch 2 of the aircraft body through an external magnetic switch, and the display screen can display (controlled by the MCU) environmental information (acquired by the sensor under the control by the MCU) during the current operation and aircraft body state information (output between the human and the aircraft) to implement the interaction process between the human and the aircraft.

Obviously, the underwater aircraft is waterproof and airtight, and those skilled in the art can perform sealing and waterproof settings according to actual needs without creative work, and descriptions are no longer made herein.

This embodiment has the beneficial effects that this embodiment has all the beneficial effects of Embodiment 1; in addition, it has a fully enclosed buoyancy design; the buoyancy block 6, the upper buoyancy plate 15, and the lower buoyancy plate 16 are designed between the two propulsion cylinders, which can reduce resistance and increase buoyancy without adding an external floating block, thereby preventing the device from falling into the water, sinking to the bottom and being lost, reducing device costs, and reducing operation steps; the speed of the propeller can be adjusted through gears, and the pressure sensor 14 is arranged to effectively measure the speed of motion and underwater penetration, which can be displayed on the status display screen 3; when the depth reaches a certain value, the indicator lamp flashes to remind the user that he/she may reach a dangerous depth; and the status display screen 3 can display a working state of the device, such as voltage, current, speed, depth, and electric quantity, and an alarm will be made according to the flashing of the indicator lamp if there is an abnormality.

The handheld underwater aircraft of the present disclosure has significant beneficial effects. The structure of the present disclosure is described in detail above, and the impact of the included angle α between the axis of the propeller and the axis of the battery compartment 12 on the present disclosure is described below through test data.

The included angle α has a certain influence on the working efficiency of the propeller. Therefore, in order to achieve a better working effect of the propeller, it is necessary to test the relationship between the included angle α and the working efficiency of the propeller.

Because when the included angle α is greater than 10 degrees and less than 45 degrees, the energy consumption of the propeller is significantly reduced under the same operation speed of the present disclosure. In this experiment, data of the included angles of 0-10 degrees was mainly tested and analyzed.

In the following test, the distance between axes of the two propellers was 471.06 mm (this distance was the distance between the axes of the two propellers). Since a simplified model was adopted in the simulation experiment, in order to reduce the impact of the difference between the simplified model and an original model, the included angle α of the experimental test was 0 degree, 5 degree, and 10 degrees.

Figure 4:
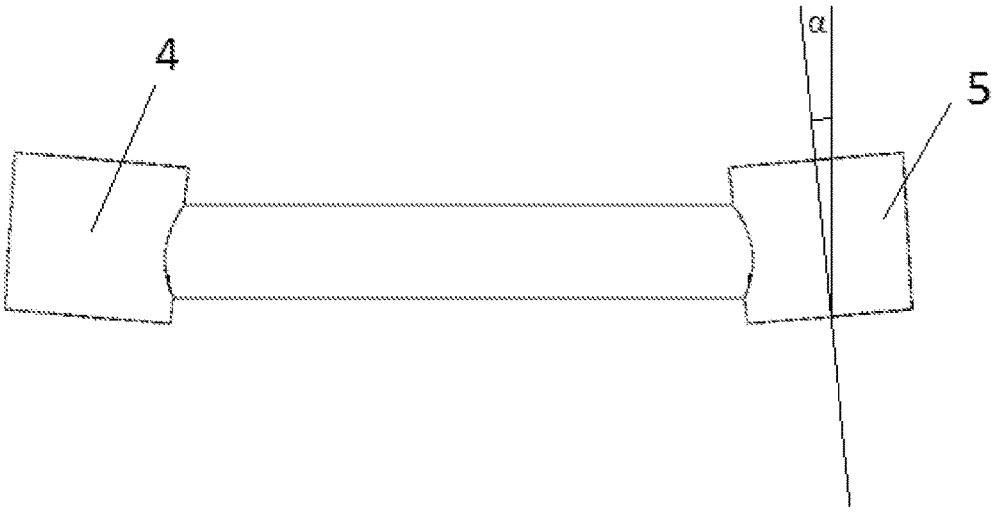
FIG. 4 is a schematic diagram of a simplified model used in a test experiment in Embodiment 2.

The simplified model of the present disclosure used in the experiment is shown in a schematic diagram shown in FIG. 4.

Figure 5:
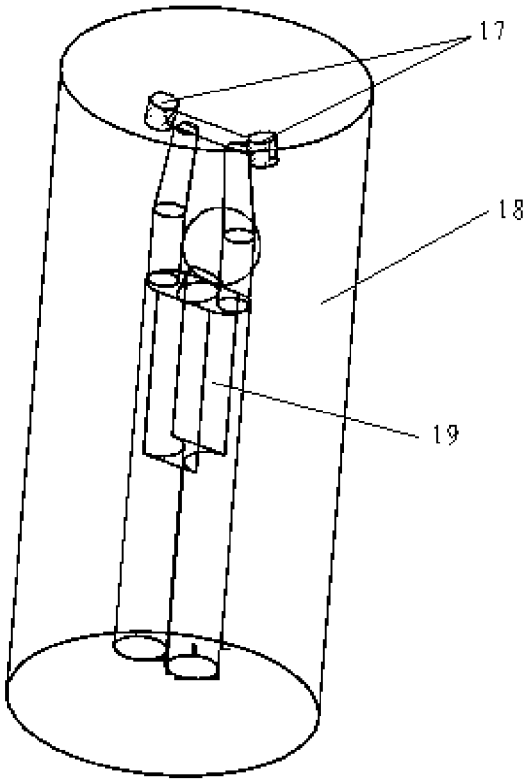
FIG. 5 is a schematic diagram of a flow field model of the test experiment in Embodiment 2.

A flow field model is shown in FIG. 5. Two dynamic domains are regions in a fairwater of the two propellers, and are two cone frustums having radiuses of 51.5 mm and 48.5 mm, respectively, and a height of 102 mm, which are compatible with the shape of the fairwater. The rotational speed of the dynamic domain 18 is 3000 rpm, and the rotation axis is the axis of the dynamic domain. The static domain 17 is a cylinder with a radius of 600 mm and a height of 2700 mm A simulated human body 19 simulates the human body in the static domain 17 to hold the present disclosure with two hands.

Initial conditions of the simulated flow field are set as follows: The water flow speed at an inlet surface (a water inlet surface) is 1 m/s; the dynamic domain has a rotational speed of 3000 rpm, a rotation origin is a center coordinate of the dynamic domain, and the direction of the rotation axis is the same as the axial direction of the dynamic domain.

Figure 6A:
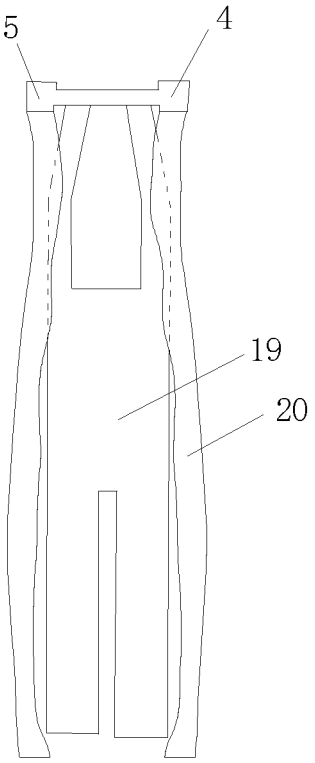
FIG. 6*a* is a schematic diagram of a simulation test result when the included angle $\alpha$ is 0 degree.
Figure 6B:
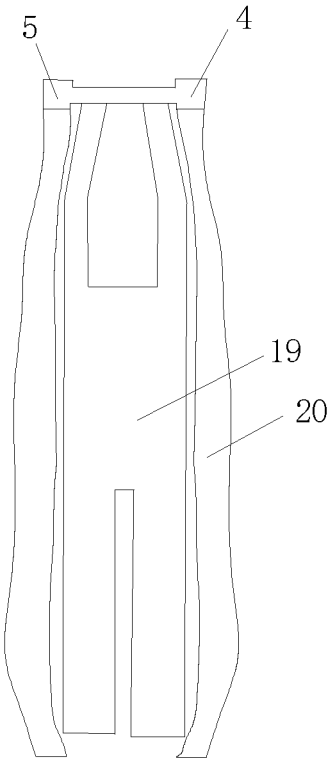
FIG. 6*b* is a schematic diagram of a simulation test result when the included angle $\alpha$ is 5 degrees.
Figure 6C:
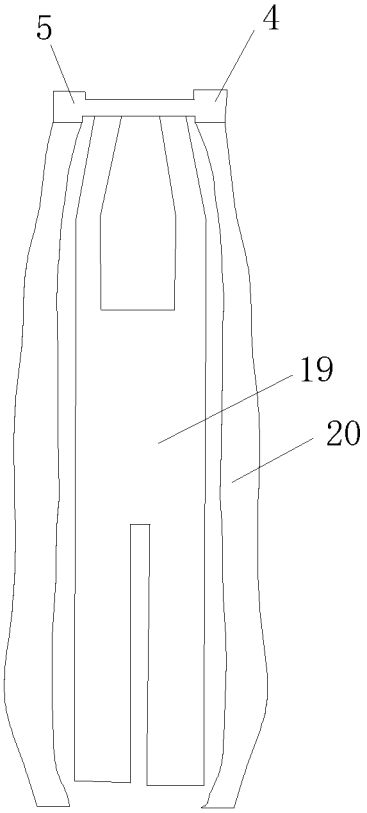
FIG. 6*c* is a schematic diagram of a simulation test result when the included angle $\alpha$ is 10 degrees.

Test results are shown in FIG. 6*a*, FIG. 6*b*, and FIG. 6*c*. The test results are that in FIG. 6*a*, when the included angle is 0 degree, water flow 20 coming out of the propeller overlaps with the simulated human body 19, that is, the water flow emitted by the propeller strikes on the human body, thereby affecting the speed in the flow domain; and when the included angle is 5 degrees or 10 degrees, the water flow emitted out of the propeller will not strike on the human body, but when the included angle is 10 degrees, the speed loss in the traveling direction is too large, so it is the most suitable when the propeller angle is 5 degrees.

Stress data of blades is as follows:

| Included angle α | 0 degree | 5 degrees | 10 degrees |
|---|---|---|---|
| Blade stress (left) | 42.7126 N | 55.0803 N | 40.1476 N |
| Blade stress (right) | 41.8660 N | 54.5863 N | 40.0178 N |
| Blade stress (mean value of the left stress and the right stress) | 42.2893 N | 54.8333 N | 40.0827 N |

From the above data, it can be seen that when the included angle α is 5 degrees, the stress on the left blade and the stress on the right blade are maximums, and in this case, the propeller can have the maximum thrust and the included angle is the optimal included angle.

The flow speed in the flow field obtained in the simulation is as follows:

| Included angle α | 0 degree | 5 degrees | 10 degrees |
|---|---|---|---|
| Average speed of the static domain | 1.00181 m/s | 1.5158 m/s | 0.96897 m/s |
| Average speed in the static domain in the y-axis direction (a negative value means opposite to the y-axis direction) | −0.95222 m/s | −1.42862 m/s | −0.91488 m/s |
| Maximum speed in the static domain | 3.23066 m/s | 4.27397 m/s | 3.24015 m/s |
| Maximum speed in the static domain in the y-axis direction (a negative value means opposite to the y-axis direction) | −3.03575 m/s | −4.00060 m/s | −3.11736 m/s |

It can be seen from the simulation results that the average speed in the static domain in the y-axis direction is the maximum when the included angle is 5 degrees.

It can be seen from the above data that when the included angle α is 5 degrees, the speed of the propeller in the advancing process is the maximum, and in this case, the included angle is the optimal included angle.

In conclusion, the optimal included angle α between the axis of the propeller and the axis of the battery compartment 12 is 5 degrees.

In the description of the specification, descriptions with reference to the terms "Embodiment 1", "Embodiment 2", "examples", "specific examples", or "some examples" etc. mean specific methods, apparatuses or features described in conjunction with the embodiments or examples are included in at least one embodiment or example of the present disclosure. In the specification, the illustrative expressions of the above terms do not necessarily refer to the same embodiments or examples. Furthermore, the specific features, method, apparatuses or characteristics described may be combined in any one or more embodiments or examples in a suitable manner. In addition, those skilled in the art can combine the different embodiments or examples and the features of the different embodiments or examples described in the specification without contradicting with each other.

The above are only the preferred embodiments of the present disclosure, and are not intended to limit the present disclosure. Any modifications, equivalent replacements and improvements, and the like made within the spirit and principles of the present disclosure should fall within the protection scope of the present disclosure.

What is claimed is:

1. A handheld underwater aircraft, comprising a battery compartment and propellers, wherein there are at least two propellers, which are symmetrically arranged with respect to the battery compartment, and are connected to the battery compartment; and an axis of each of the propellers and an axis of the battery compartment form an included angle;

wherein a water inlet end of each of the at least two propellers is biased toward the battery compartment; and wherein the included angle is 5 degrees.

2. The handheld underwater aircraft according to claim 1, wherein there are two propellers, and the two propellers are connected by a buoyancy block.

3. The handheld underwater aircraft according to claim 2, wherein the buoyancy block is arranged in front of the battery compartment, and is a curved plate with a middle portion protruding forward.

4. The handheld underwater aircraft according to claim 2, wherein the propeller and the battery compartment are connected by a buoyancy bridge, and handles are arranged on the buoyancy bridge.

5. The handheld underwater aircraft according to claim 4, wherein the buoyancy bridge comprises an upper buoyancy plate and a lower buoyancy plate which are arranged in parallel, and both ends of the upper buoyancy plate and both ends of the lower buoyancy plate are connected to the two propellers respectively; an upper end of the battery compartment is mounted on a middle portion of a lower surface of the upper buoyancy plate, and a lower end of the battery compartment is mounted on a middle portion of an upper surface of the lower buoyancy plate; the handles are symmetrically arranged on two sides of the battery compartment, an upper end of each of the handles is connected to the upper buoyancy plate, and a lower end of the handle is connected to the lower buoyancy plate; one of the handles is provided with a propeller switch, and the other handle is provided with a power switch.

6. The handheld underwater aircraft according to claim 4, wherein the buoyancy block, the upper buoyancy plate, the lower buoyancy plate, and the handle each have a hollow structure.

7. The handheld underwater aircraft according to claim 5, wherein the propellers are each a variable speed propeller, a gear adjustment switch for controlling the variable speed propeller is arranged on the handle or on a side wall of the battery compartment, and each of the variable speed propellers is correspondingly provided with one gear adjustment switch.

8. The handheld underwater aircraft according to claim 1, further comprising a status display screen, wherein the status display screen is arranged on an outer side wall of the battery compartment, and a power supply in the battery compartment and the propeller are in circuit connection with the status display screen; the status display screen is configured to display parameter information of the power supply in the battery compartment and the propeller;

further comprising a pressure sensor mounted on the lower front of the battery compartment, wherein the pressure sensor is in circuit connection with the status display screen, and the status display screen is configured to display detected data of the pressure sensor; and further comprising an indicator lamp arranged on the status display screen.

* * * * *